US010058131B2

(12) United States Patent
Solano et al.

(10) Patent No.: US 10,058,131 B2
(45) **Date of Patent: *Aug. 28, 2018**

(54) BUTT ENHANCING HOSIERY/SHAPER UNDER GARMENT

(71) Applicants: Yajaira Solano, Patchogue, NY (US); Bruce Moncado, Patchogue, NY (US)

(72) Inventors: Yajaira Solano, Patchogue, NY (US); Bruce Moncado, Patchogue, NY (US)

( * ) Notice: Subject to any disclaimer, the term of this patent is extended or adjusted under 35 U.S.C. 154(b) by 358 days.

This patent is subject to a terminal disclaimer.

(21) Appl. No.: 15/017,332

(22) Filed: Feb. 5, 2016

(65) Prior Publication Data

US 2016/0150832 A1 Jun. 2, 2016

Related U.S. Application Data

(63) Continuation-in-part of application No. 14/735,362, filed on Jun. 10, 2015, now Pat. No. 9,867,400, which is a continuation-in-part of application No. 14/103,044, filed on Dec. 11, 2013.

(51) Int. Cl.

| | |
|---|---|
| ***A41B 11/04*** | (2006.01) |
| ***A41B 11/14*** | (2006.01) |
| ***D04B 1/24*** | (2006.01) |
| ***A41B 11/00*** | (2006.01) |
| *A41C 1/08* | (2006.01) |

(52) U.S. Cl.

CPC ..... *A41B 11/14* (2013.01); *A41B 11/00* (2013.01); *A41B 11/003* (2013.01); *D04B 1/24* (2013.01); *A41B 2400/38* (2013.01); *A41C 1/08* (2013.01)

(58) Field of Classification Search

CPC ..... A41B 11/003; A41B 11/004; A41B 11/08; A41B 11/12; A41B 11/14; A41B 11/00; A41C 1/02; A41C 1/00; A41C 1/08; D04B 1/26; D04B 1/24

See application file for complete search history.

(56) References Cited

U.S. PATENT DOCUMENTS

| | | | | |
|---|---|---|---|---|
| 3,824,812 A * | 7/1974 | Matthews | A41B 9/08 | 2/409 |
| 3,909,851 A * | 10/1975 | Garrou | A41B 11/14 | 2/409 |
| 6,276,176 B1 * | 8/2001 | Blakely | A41B 11/14 | 66/178 R |
| 7,081,036 B1 * | 7/2006 | Howard | A41C 1/00 | 450/100 |
| 7,260,961 B1 * | 8/2007 | Kennedy | D04B 1/243 | 66/171 |

(Continued)

*Primary Examiner* — Katharine Gracz

(74) *Attorney, Agent, or Firm* — Alfred M. Walker

(57) ABSTRACT

A body worn hosiery/shaper uplifts the rear buttocks in an expandable thin material region, by virtue of respective left and right flank members, which cause the uplifting of the rear buttocks region. The flank members are supported from above by an annular upper waist knitted in welt, that extends circumferentially around the upper rib area. Upper thigh ring cuff portions also help with the uplifting of rear buttocks region from below while the high waisted control top control stomach and back side bulge. The body worn hosiery/shaper also optionally provides sheer leg portions that end just before the toes leaving the toe portion open. An extra wide open crotch double gusset is also provided allowing the user to utilize the restroom when nature calls.

25 Claims, 11 Drawing Sheets

(56) References Cited

U.S. PATENT DOCUMENTS

| | | | | |
|---|---|---|---|---|
| 2002/0007507 | A1* | 1/2002 | Duran | A41B 11/003 2/406 |
| 2004/0006811 | A1* | 1/2004 | McKenzie | A41B 11/14 2/240 |
| 2010/0235970 | A1* | 9/2010 | Rad | A41B 11/14 2/409 |
| 2011/0289648 | A1* | 12/2011 | Burke | A41D 13/0015 2/69 |
| 2014/0057530 | A1* | 2/2014 | Mazourik | A41B 9/04 450/100 |

* cited by examiner

BUTT ENHANCING HOSIERY/SHAPER UNDER GARMENT

RELATED APPLICATIONS

This application is a continuation-in-part of application Ser. No. 14/753,362 filed Jun. 10, 2015, which '362 application is a continuation-in-part of application Ser. No. 14/103,044 filed Dec. 11, 2013 and claims priority in part therefrom under 35 USC § 120. Applicant also claims priority from international application number PCT/US2014/069344, filed Dec. 9, 2014.

FIELD OF THE INVENTION

The present invention relates to form fitting hosiery for uplifting the rear buttocks area.

BACKGROUND OF THE INVENTION

The conventional type of hosiery/shaper undergarment usually includes traditional under wear, panty hose, and girdles. These traditional undergarments compress the buttocks, offer no support on the upper thigh and they create bulges under clothing.

The conventional hosiery/shaper undergarment includes a pair of legs knit solely of stretchable yarn and providing sufficient stretchability to fit a range of leg sizes while providing a relatively small amount of compressive force against the underlying legs of the wearer. They compress the buttocks and provide no support on the upper thigh and area around the waist love handle. These hosiery undergarments do not have a control top that extends high enough to provide support to the upper torso bulge (the bulge can be really seen from the upper back area under the armpits). Some types of hosiery undergarments, the so-called "panty girdle" type, include a panty girdle formed of a heavy elastic fabric with the upper ends of hosiery legs being sewn to the leg openings in the panty girdle. This type of panty girdle applies a great amount of compressive force against the underlying portion of the body of the wearer while the portions of the stockings immediately adjacent to the leg openings apply very little, if any, compressive force against the upper thigh portions of the legs of the wearer. This immediate transition from high compressive force by the panty girdle to little or no compressive force by the adjacent hosiery leg causes an abrupt outward bulging of the portions of the upper thighs below the leg openings of the panty girdle portion and these bulge lines are visible when the panty hose is worn beneath tight-fitting slacks or skirts.

This type of hosiery undergarment also compresses the buttocks in a way as to not allow a round naturally shaped buttocks to emerge. This type of hosiery undergarment also does not provide an open toe along with an open crotch (open gusset), buttocks shaping and high waist control top for a full body shaping experience.

These types of undergarments do not provide the user with an improved appearance under clothing and can be uncomfortable. They do not allow the buttocks to form a more round improved appearance that actually creates volume in the rear using your own natural shape. By using the same girdle type material on the buttocks it does not allow the fabric to go between the buttocks like a g-string region to give a more natural curvy appearance, instead the buttocks is compressed by the same material used throughout the undergarment. Furthermore, they do not hold in bulges and cellulite on the most troubled areas of some users. These areas, known as "saddlebags", are below the buttocks on the back and sides of the thighs just below the hips. Although girdles cover these areas, they normally are made of relatively thick material and tend to compress the buttocks rather than mold it pushing those bulge areas upward and outward to form a more curvy buttocks. Instead they create bulges in clothing about the user's thigh. Also, the thick fabric usually makes the user look heavier rather than thinner in slim fitting clothing. These types of garments also do not provide a crotch opening (open gusset) so that the user can easily use the bathroom without having to take the garment off which can be time consuming and uncomfortable. These types of undergarments stop just below the knee or extend to the ankle which make it visible if the wearer were to wear short skirt or shorts. Some of these undergarments have a stocking that does extend down to the foot but do not provide an open toe so that the wearer can wear open toe shoes with out being visible.

Often the control top, does not extend high enough on the waist to control the bulges which may be more visible from the back view. These control tops often fall down since they do not have straps that can be attached to a bra and or silicone on the waistband to prevent it from falling. Also, the waist and leg portions have elastic bands at their points of termination that do not solve the problem of bulges that occur from immediate high compressive force to little or no compression.

Hosiery undergarments that currently exist in the market place are designed to give a toned look to legs smoothing the site of cellulite and the legs overall. Originally the hosiery undergarments only extending to the waist giving no support to the upper thigh region, waist and buttocks. A need exists for an undergarment that does it all. The traditional hosiery undergarments just focus on the toning smoothing look of the legs but fail to shape the body.

Although undergarments are known that are designed to provide support to waist and leg portions of the body, U.S. Pat. No. 6,463,765 of Blakely, is mostly concerned with compressing everything in. This girdle type garment extends to just below the knee and compresses everything in including the buttocks deforming it. This undergarment does not solve the problem of shaping the buttocks to give a "JLO®" curvy shape. Instead it compresses the buttocks giving the wearer a less curvy shape. The control top also does not extend high enough to control back bulge on the area just under the breasts of a women which can be seen from the back. This control top does not provide extra compression on the side mid portion of the waist giving the wearer more support for a more "hour glass" look. The control top does not solve the problem of preventing the control top from sliding down when worn. This garment also does not extend to the feet of the wearer giving the legs a toned smoothed look which can be worn with shorts and skirts. This garment cannot be worn with shorts or skirts due to the fact that the garment would be seen stopping just above the knee and it is not designed to give the legs a toned smooth look all the way to the foot. On this garment a crotch gusset can be seen but it is not an open crotch double gusset which does not solve the problem of convenience. When the need to use the rest room occurs, the entire undergarment must be removed and then put back on, which can be time consuming and a very uncomfortable hassle.

U.S. Pat. No. 4,267,607 of Tino discloses a traditional panty hose with reinforced heel and toe. This garment does not solve the problem of tummy bulge with a high waist control top nor does it solve the problem of too much buttocks compression. This garment does extend to the feet, however it does not provide an open toe so that a wearer can utilize it with open toe shoes.

U.S. Pat. No. 5,097,537 of Ewing discloses a multisectional hosiery garment that has detachable feet and leg sections. This design is intended to prevent the entire pantyhose from being ruined if a "run" occurs in a portion of the garment. The design is also intended to accommodate several different fashion purposes. The different sections are attached with elastic bands, which have disadvantages. A garment having this design would not provide the user with a slimmer or smoother appearance.

U.S. Pat. No. 5,787,732 of Duran discloses a traditional panty hose with interconnected portions so as to define a pair of panty hose. This garment does not solve the problem of tummy bulge with a high waist control top nor does it solve the problem of too much buttocks compression. This garment does not increase volume in the buttocks. The side bands extend to the stomach area which creates more bulge in the abdomen area which can be seen through clothing.

United States Pub No. 2004/0006811 A1 of McKenzie discloses a panty hose undergarment that includes a waistband portion, a control top portion and leg portions knitted to the control top portion. This garment of McKenzie '811 has in one embodiment elastic shirring sewn down the center back and sewn down the seam to the crotch panel while being stretched. This creates a problem of having an uncomfortable seam being pulled in between the buttocks like a what is colloquially known as a "wedge".

The McKenzie '811 garment embodiment with a shirring seam also provides a control top portion with a heavy support knit starting under the buttocks, on the sides, in between the buttock cheeks, and up the waistband; and light support knit on the buttock peak areas; and medium support knit on the remaining area of the control top. The denser knit portion 307 shown in FIG. 9 of McKenzie has support up the side of body and ends in the back, as shown on drawing FIG. 9. This does not solve the problem of an undesirable stomach bulge. The control top 301 of McKenzie ends at the lower waist, which could allow a stomach bulge to spill over. This garment of McKenzie '811 also does not solve the problem of a wide over lapping open gusset. It provides a small oval gusset which would make it very uncomfortable to use the restroom.

The stretchable knit sections 108, 208, 308 and 408 in McKenzie '811 provide a smaller buttocks opening (McKenzie refers to the region being the "peaks of the buttocks") which could deforms the buttocks to an unnatural smaller cone shape rather than a round voluptuous shape of the full area of all of the buttocks.

OBJECTS OF THE INVENTION

Accordingly, a need exists for a comfortable hosiery garment that helps shape the buttocks to form a more round improved appearance, one that actually creates volume in the buttocks using the wearer's own natural shape and mass by compressing the bulge on the upper thigh upward and outward along with the buttocks to form a more curvy round looking buttocks instead of compressing the buttocks.

A need also exists for one that also covers the entire leg down to an open toe giving the legs a smoother more toned look. A need also exists for such a hosiery garment to have a very high waist control top to eliminate love handle and back bulge, to have an open crotch double gusset and to be manufactured in a continuous knitting process so that the supportive regions blend in with the more sheer regions without creating seams or bands that can easily be seen through clothing.

Also a need exists for providing an open toe so that it may be worn with open toe shoes and skirts. Also a need exists for same garment that gives support in the thigh, and higher waist regions to help minimize or eliminate side upper torso bulge, stomach and love handle bulge. A need also exists for such a hosiery shaping garment to be manufactured in a continuous knitting process.

It is therefore an object of the invention to provide a butt enhancing hosiery undergarment that allows a natural looking roundly shaped buttocks to emerge, giving an improved appearance that actually creates volume in the rear by using your own natural shape.

It is also an object of the invention to provide stomach, upper back side area and side waist compression giving the user a more "hourglass" shape.

It is also an object of the invention to provide an open toe sheer leg portion allowing the user to wear open toe shoes. It is also an object of the invention to provide a wide open crotch double gusset for convenience when nature calls.

It is also an object of the invention to provide straps that hook on to the wearer's bra if so desired for extra security to prevent the control top from sliding down, and/or a silicone or rubber inner lining on the upper waist knitted in welt to also prevent the control top from sliding down.

It is also an object of the invention to provide a version of this butt enhancing hosiery undergarment that extends to different lengths. For example, there is provided a version that extends to the ankle, another version that extends just below the knee, another that extends to just above the knee, and another that is a short version that stops at the upper thigh region which can be worn under shorts.

It is also an object of the invention to have an open back version also in different lengths which could be worn with an open back dress for example.

It is also an object of the invention to create this invention without seams and with bio crystal yarn technology in different embodiments.

It is yet another object of the invention to provide a butt enhancing shorts undergarment.

It is further an object to provide a butt enhancing outer garment.

SUMMARY OF THE INVENTION

The present invention provides a hosiery undergarment optionally having sheer leg portions that end just before the toes, and a reinforced control top portion having good shaping and control characteristics that terminates at the top of the waist region with a knitted-in welt.

The hosiery undergarment provides the user with shaping support as well as buttocks shaping support which gives a separate opening for the buttocks allowing the hosiery garment to go between the buttocks almost like a g string region while pushing, compressing the upper and side thighs upward and outward to a buttocks pouch made of a lesser denier than the surrounding, (where denier is defined by dictionary definition as a unit of weight used to measure the fineness of silk and man-made fibers, especially when woven into women's tights, etc, and being equal to 1 gram per 9000 meters), unlike the present invention, prior art pantyhose which compress and tend to flatten the buttocks inward and down, giving a smaller less natural round shape, are usually undesirable. The buttocks area portions of the hosiery undergarment are made of a very flexible material, optionally a mesh material, including a netting with strands of material having holes in between, and being thinner than surrounding material. It can be a mesh of same material of the rest of the garment, or of a different material of the rest of the material. Elastic nylon elastane is an example of a preferred material, although other types of mesh material can be used in the buttocks area of the garment.

Optionally for discrete butt enhancing outer garments, the buttocks area portions can be opaque but thin material, thinner than surrounding flank and lower crotch areas of the outer garment.

In contrast to the prior art, the reinforced high control top portion of the present invention optionally extends down the leg portions and under and around the buttocks of the pantyhose far enough to provide support over the "saddle-bag" and cellulite regions of the body while leaving a separate opening or pouch area made of the aforementioned mesh opaque trim, or thin non-mesh material, for the buttocks to form into giving a more desirable "Jlo®" look to the buttocks area. The mesh or thin material has a less compressive force than the remainder of the garment, so the buttocks push outward against the mesh or thinner material, while the side and bottom support areas are made of a firmer elastic material, to surround and support the outwardly extending buttocks from the sides, below and from above.

In contrast to the prior art of McKenzie '811, the present invention with butt enhancing hosiery is seamless and has a g-string portion that allows the natural shape of the buttocks to emerge without any wedge-type pulling from an uncomfortable shirring seam sewn up the back. The garment of the present invention does not have any seams going up the back. McKenzie '811 also does not solve the problem of providing extra buttock lift with Applicants' parallel bands that lift buttocks and provide side waist compression that Applicants' garment has. In contrast to McKenzie in a full bodied version, Applicants' garment has support bands that start under the buttocks and up the side of the waist, parallel to each other, providing buttocks lift and side waist and upper waist compression of the abdomen, stopping just under the breasts.

The knitted-in welt at the waist region blends into the high control top without causing waist constriction. Similarly, when leg portions are provided, the knitted-in welts at the ends of the leg portions blend into the leg portions without causing leg constriction. The overall design provides the user with a smooth, tight leg appearance when worn under clothing, or as an opaque outer clothing, without causing the user to suffer discomfort. An open toe is also provided allowing the user to wear open toe shoes if desired. This hosiery undergarment also provides a wider than usual open crotch double gusset that can be used with ease when nature calls. This feature allows the wearer to utilize the rest room without the hassle of taking off the entire garment.

In alternate embodiments, there can be shorter versions. For example, there can be versions that extend to the upper thigh region as shown in FIG. 9, another just above the knee as shown in FIG. 10, and another extends to the ankles in FIG. 11. In other embodiments there are also versions that extend up over the breast to a short sleeve body suit, also a version to a long sleeve body suit shown in FIG. 12, and another embodiment shown in FIG. 13 with an open back for gala wear.

Optionally, the garment may be provided as a panty shorts version, with firmer fabric material flank, top and bottom portions surrounding the expandable buttocks portion, which may be made of thin or mesh material for undergarments, or may be made of thin opaque material for outer garments, wherein further open leg accommodating ring cuff portions are immediately below the bottom of the expandable buttocks portion of the garment.

All embodiments maintain the core essence which is the buttocks shaping and side waist and stomach compression. All embodiments can be worn with different styles of clothing like shorts dresses, leggings, jeans and gala wear, among possible fashion wear outer garments. In alternate embodiments the invention may be made with bio crystal technology or any yarn of the Applicants' choosing and sewn with seamless technology. This eliminates skin creases in areas where the fabrics are sewn together. The open gusset is the same on all embodiments along with the buttocks enhancing and waist compression design configurations.

It is also known that the components of the optional control top portion and the optional leg portions may vary. For example, the full leg version of FIG. 2, the partial leg version of FIG. 10 or the short leg versions of FIG. 10 or 14, can have a long sleeve top, shown in FIG. 12. Likewise, the open back version shown in FIG. 13 can be used with any of the other versions.

These and other features and advantages of the present invention will become apparent from the following description, drawings and claims.

BRIEF DESCRIPTION OF THE DRAWINGS

The present invention can best be understood in connection with the accompanying drawings. It is noted that the invention is not limited to the precise embodiments shown in drawings, in which.

DETAILED DESCRIPTION OF THE INVENTION

The hosiery undergarment of the present invention wherein the leg portions terminate just before the toes is shown in FIGS. 1-8. With reference to each figure, the same numerals will be used to describe like elements. The undergarment may be manufactured in a conventional manner with conventional knitted fabric materials, such as, for example, nylon, LYCRA®, SPANDEX®, silk, cotton, etc. In accordance with the preferred embodiment, the undergarment 1 is preferably manufactured on a circular hosiery knitting machine using a Jaquard machine, or by warped knitted seamless (WKS) technique, or other circular hosiery knitting process. Rather than using elastic bands, knitted-in welts are knitted in during the knitting process at the upper waist-terminating region and at the open toe terminating regions. This enables the garment to be manufactured in one, continuous knitting process, as opposed to performing an additional manufacturing process after the knitting process has been performed in order to attach elastic bands. Circular knitting machines and processes are well known. Those skilled in the art will understand the manner in which the garment 1 of the present invention can be manufactured using such a machine and process.

Figure 1:
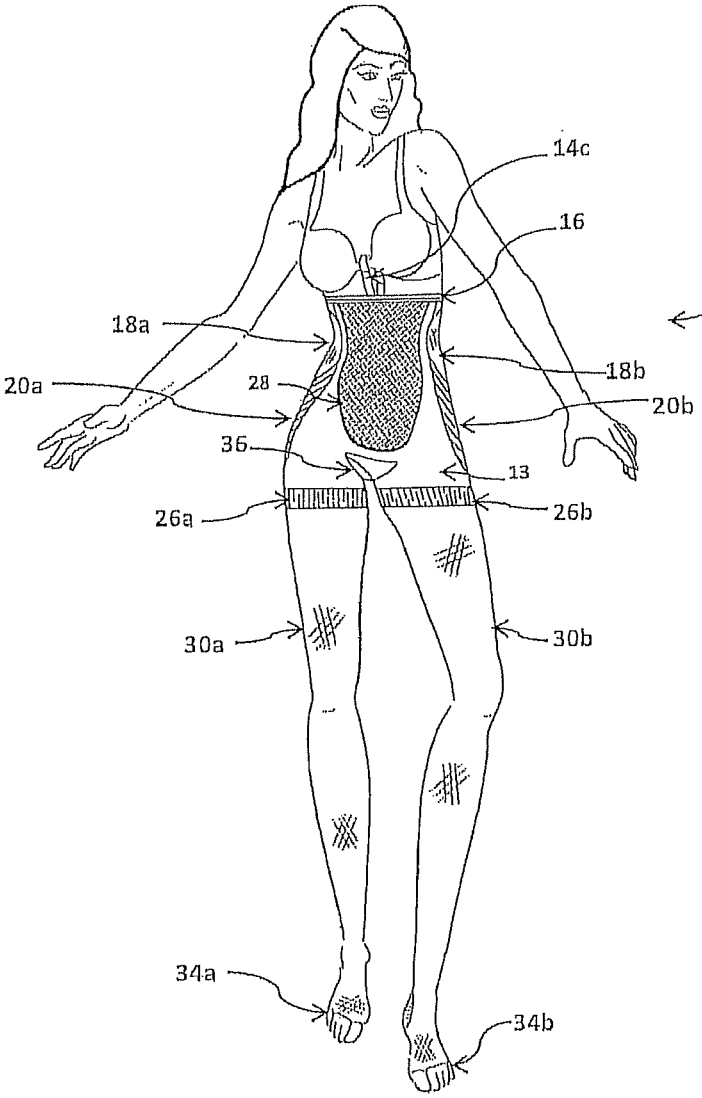
FIG. 1 illustrates a front perspective view of the hosiery undergarment of the present invention.
Figure 2:
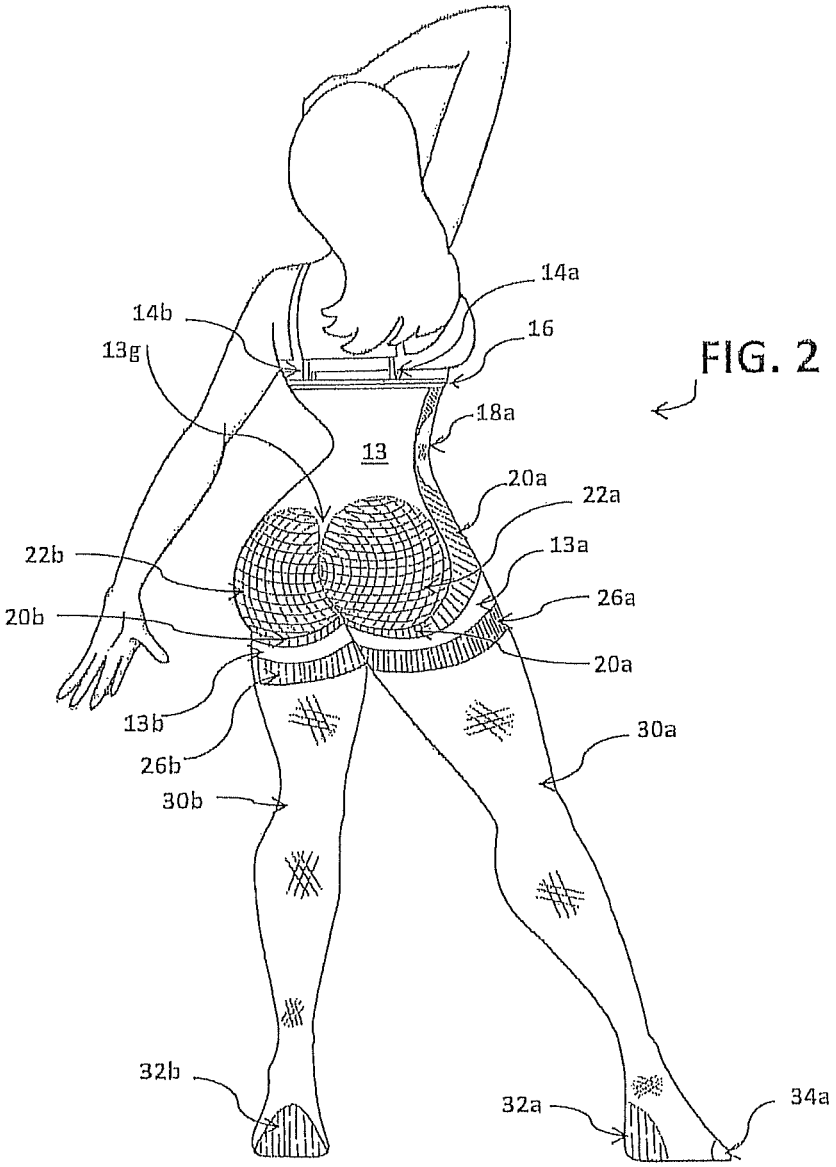
FIG. 2 illustrates a rear perspective view of the hosiery undergarment of the present invention.
Figure 3:
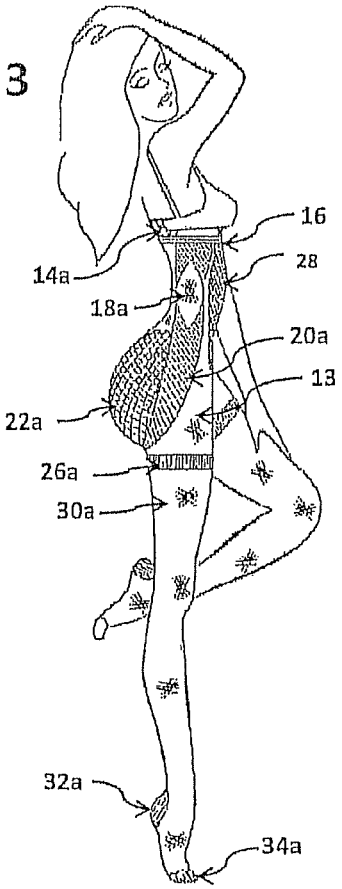
FIG. 3 illustrates a right side perspective view of the hosiery undergarment of the present invention.
Figure 4:
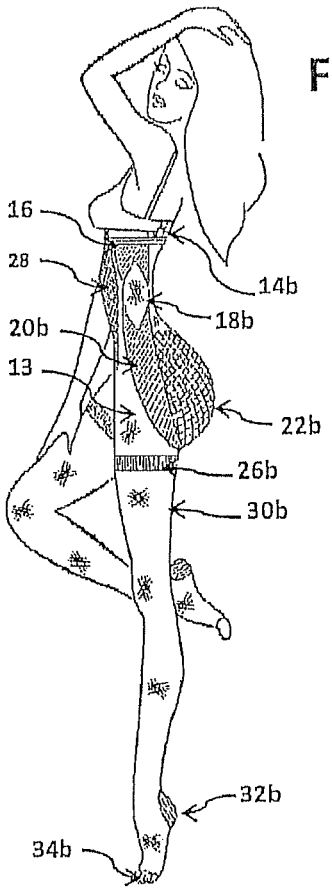
FIG. 4 illustrates a left side perspective view of the hosiery undergarment of the present invention.

The hosiery undergarment referring to FIGS. 1-8 shows front, back and side views of the undergarment comprising two leg portions 30*a* and 30*b* and a control top portion 13. The control top portion 13 of the garment preferably is terminated at the upper waist with a knitted-in welt 16 and preferably with a silicone or rubber inner lining to prevent from sliding down. The welt 16 preferably ranges from 1 to 3 inches in width. The knitted in welt 16 has a detachable strap 14*a*, 14*b*, as shown in FIGS. 2 and 14*c* as shown in FIG. 1, that hooks on to the wearer's bra if so desired for extra security to prevent the control top from sliding down.

Figure 9:
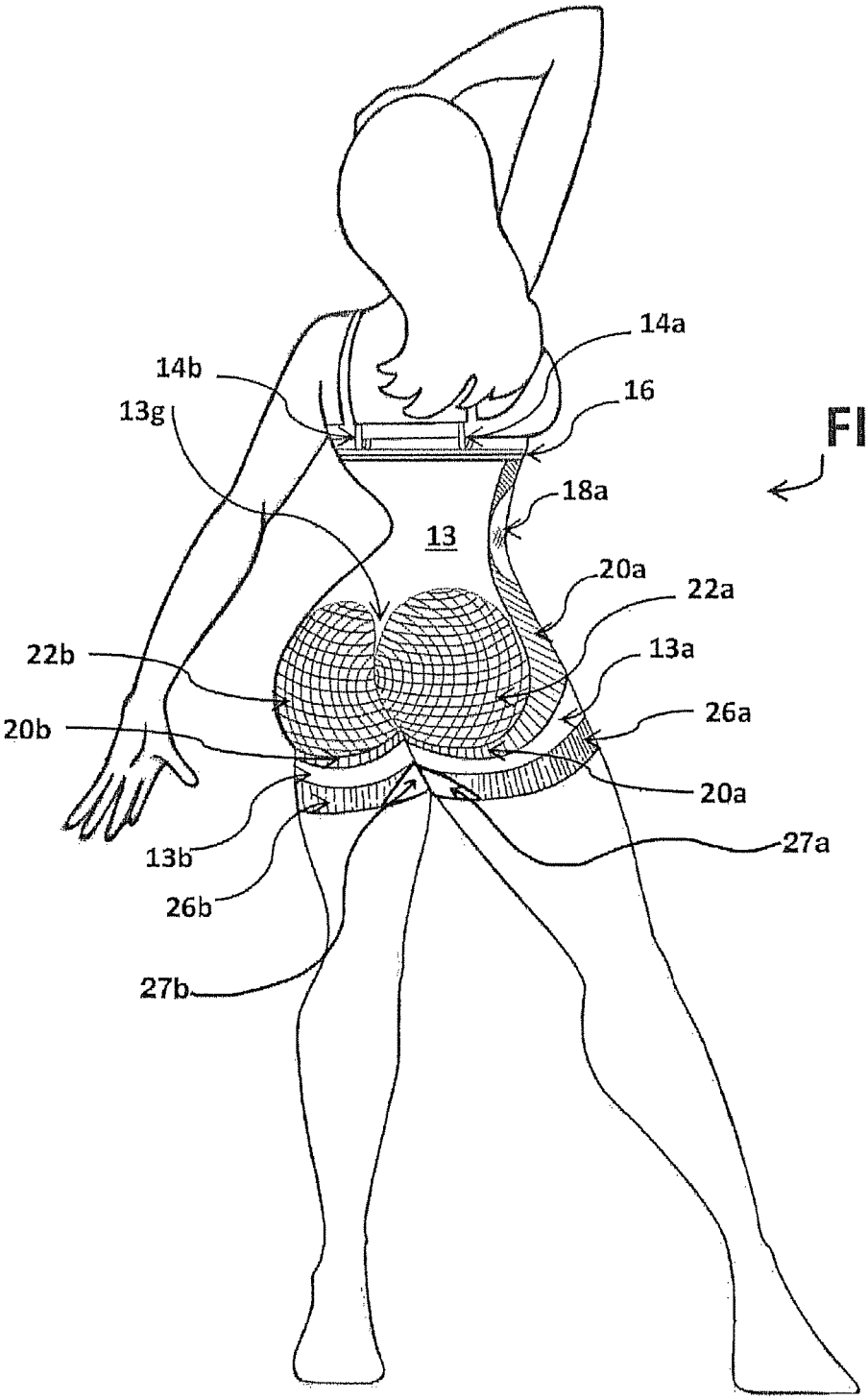
FIG. 9 illustrates a rear perspective view of the hosiery undergarment of the present invention for the short version of the new embodiment.
Figure 10:
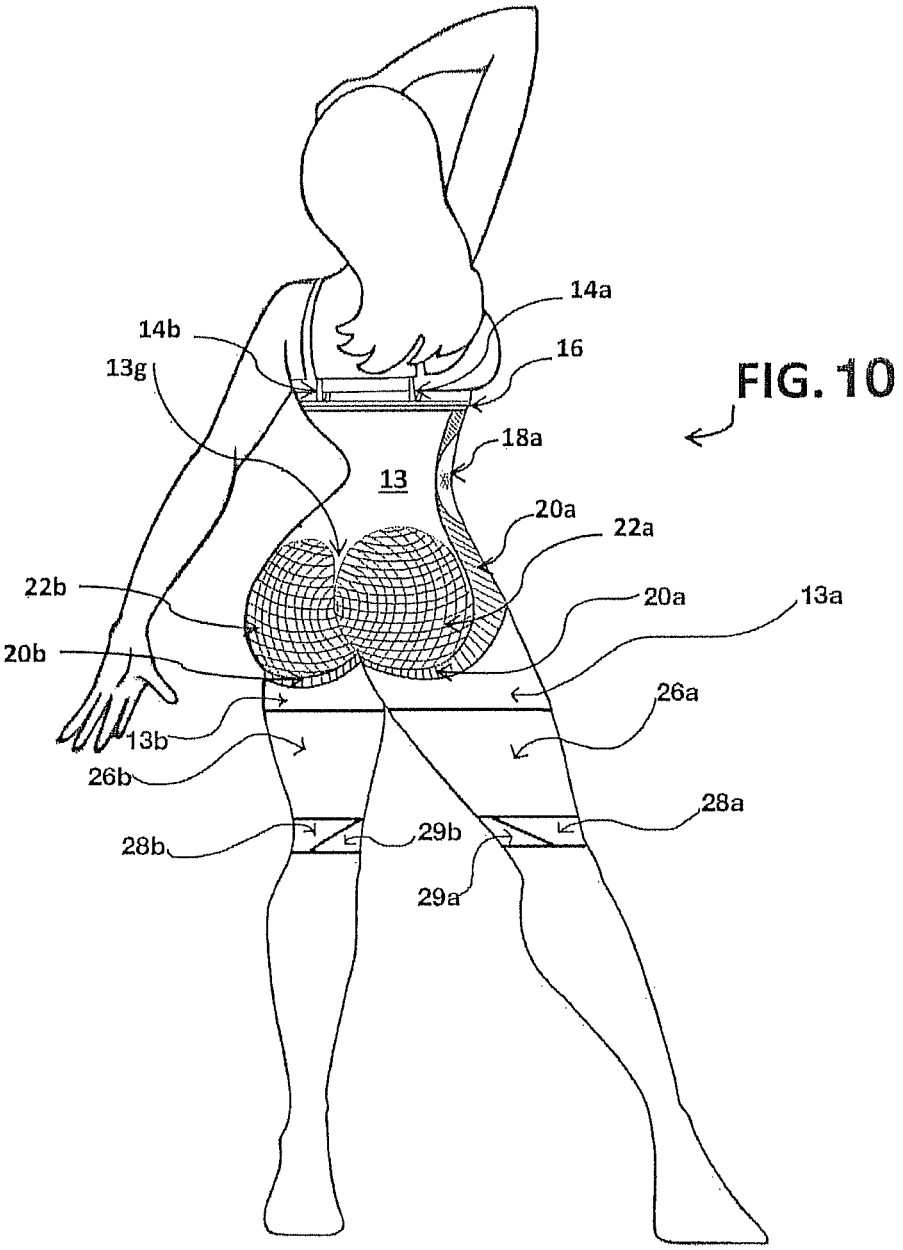
FIG. 10 illustrates a rear perspective view of the hosiery undergarment of the present invention for the short version which extends to just above the knee.
Figure 11:
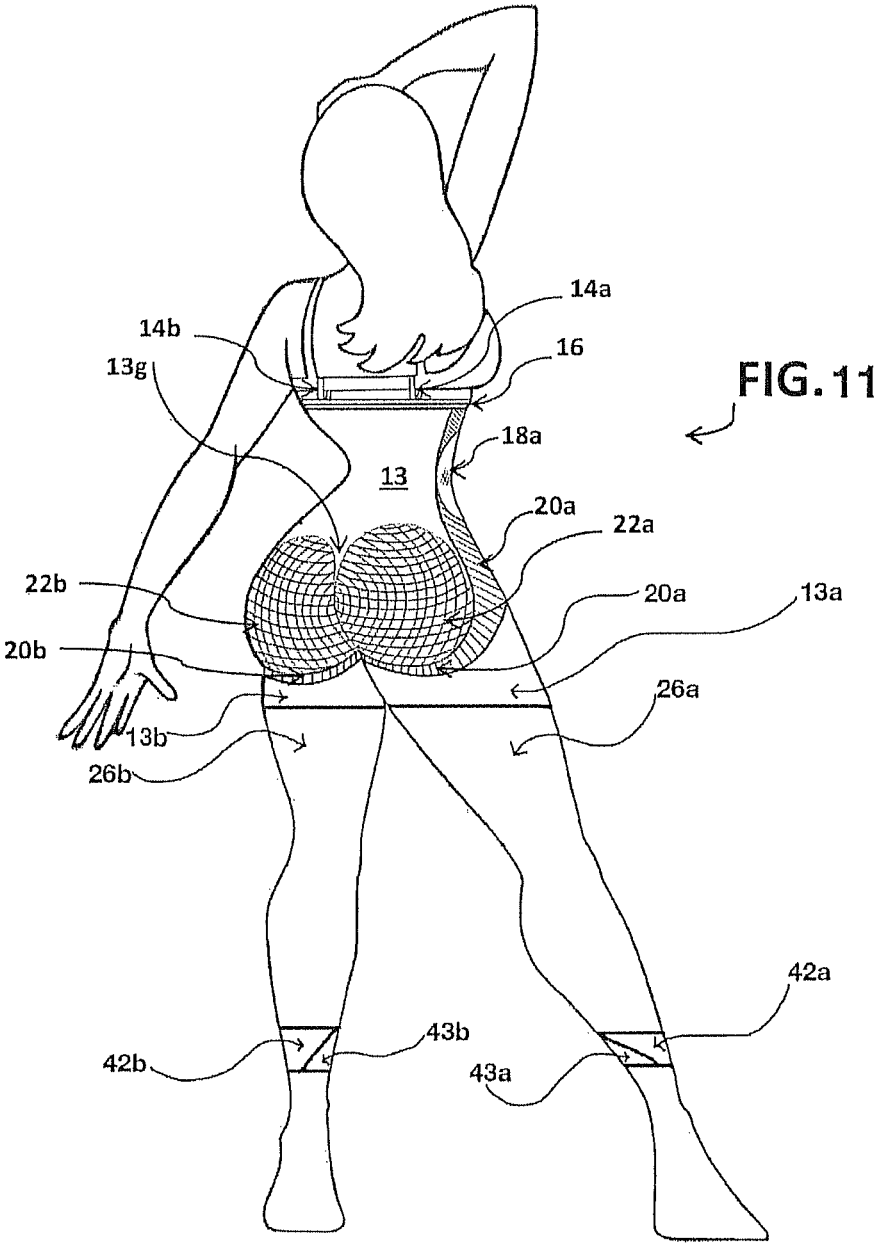
FIG. 11 illustrates a rear perspective view of the hosiery undergarment of the present invention for the long version of the new embodiment which extends to the ankles.
Figure 12:
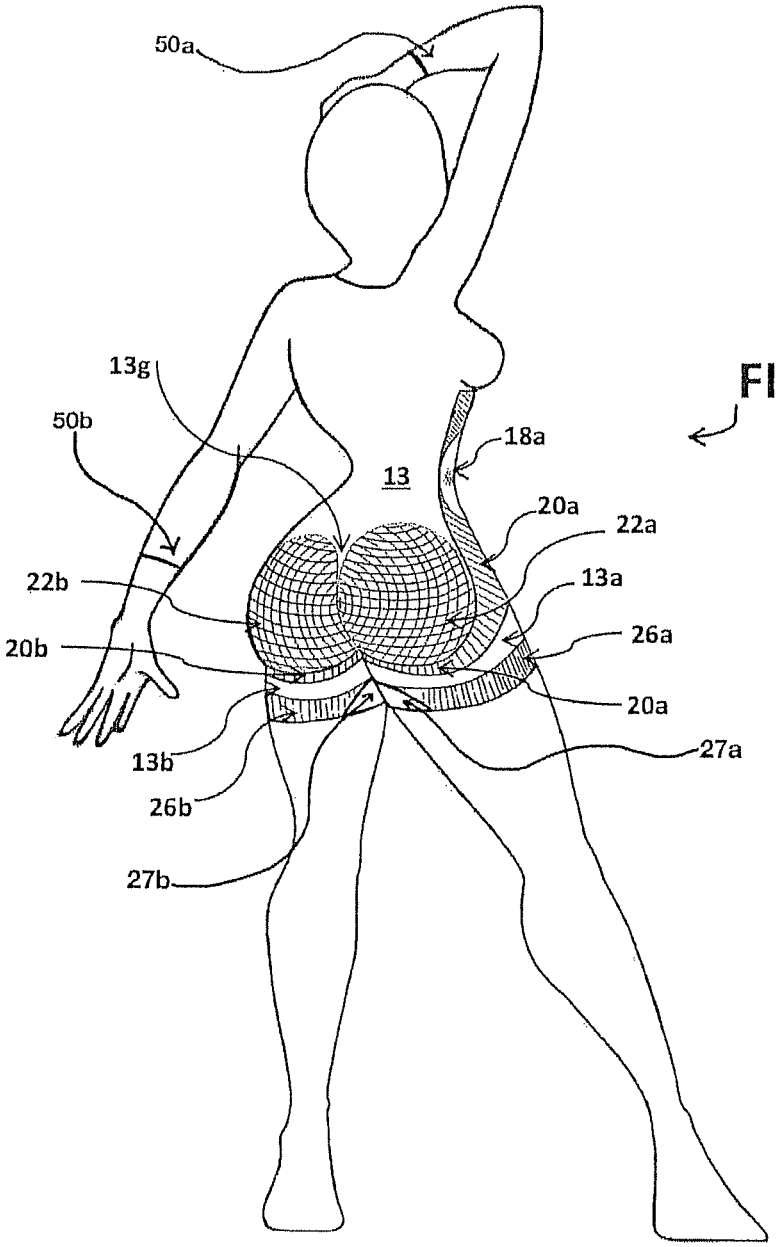
FIG. 12 illustrates a rear perspective view of the hosiery undergarment of the present invention for the long sleeve version of the new embodiment.
Figure 13:
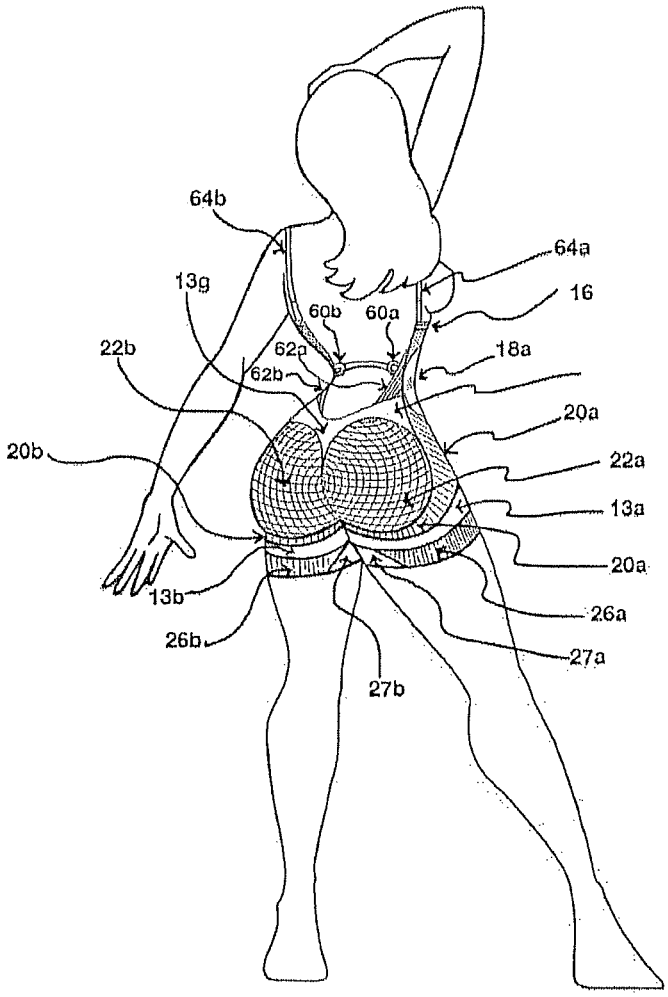
FIG. 13 illustrates a rear perspective view of the hosiery undergarment of the present invention with the open back gala version.

While FIGS. 1-8 show full leg portions including extending to the toes of the wearer, in alternate embodiments, the leg portions cover at least a portion of the user's legs. For example, as shown in FIGS. 9 and 13, the legs may cover only the upper thighs of the wearer, as in short shorts, or, as shown in FIG. 10, may cover down to just above the knees, as in Bermuda shorts. Alternatively, they may extend down and cover the knees (not shown), as in "Knickerbockers pants" or "knee pants". Additionally, as shown in FIG. 11, the leg portions may extend down toward the ankles, but not include the feet, as in Capri or "pedal pusher" type pants. Therefore the hosiery/shaper undergarment can cover at least a portion of the legs of the wearer, or the entire legs and feet to the toes of the wearer.

The thin rear buttocks region portions 22*a*, 22*b* of soft microfiber or other expandable material is uplifted by virtue of the denser left and right flank members 20*a* and 20*b*, which cause the uplifting of the thin rear region 22*a* and 22*b*. The buttocks areas 22*a* and 22*b* are made of a very flexible material, preferably a mesh material or other thin, expandable material, comprising a netting with strands of material having holes in between, or for an outer garment, made of an opaque, discrete, thin, expandable material, and in each case being thinner than surrounding material. It can be a mesh of same material of the rest of the garment, or of a different material of the rest of the material. Elastic nylon elastane is an example of a preferred material, although other types of mesh material can be used in the buttocks area of the garment.

The flank members 20*a* and 20*b* are optionally supported from above by the upper waist knitted in welt 16 that extends circumferentially around the rib area. The upper thigh ring portions 26*a*, 26*b* also help with uplifting of rear, less compressive mesh region 22*a*, 22*b*. Additionally, unlike in McKenzie '811 where only a reduced portion of the buttocks is covered by the less dense areas 108, 208, 308, 408, in contrast, in the present invention of Applicants, each of the buttocks is substantially covered by the left and right mesh or other thin, expandable material portions 22*a* and 22*b* of the rear buttocks cover material. Although the buttocks areas are bordered on the outside edges by left and right flank members 20*a* and 20*b*, there is a minimal seamless separation in the intergluteal cleft crack groove that runs below the sacrum of the spine between the buttocks to the perineum area of the crotch between the rear buttocks mesh or other thin, expandable material regions 22*a* and 22*b*, in the area extending below the sacrum to the perineum area of the crotch between the legs. For example, while dimensions may vary, the seamless separation in the intergluteal cleft crack groove between the left and right buttocks mesh or other thin, expandable material regions 22*a* and 22*b* is about one quarter (¼) inch in width, thereby capturing all of the buttocks in the thin left and right expandable buttocks mesh or other thin, expandable material areas 22*a* and 22*b*. There is also a minimal seamless separation between the outer left and right circumferential arc portions of the rear buttocks mesh or other thin, expandable material regions separating the rear buttocks mesh regions from the respective denser left and right flank members 20*a* and 20*b*, thereby capturing all of the buttocks in the thin left and right expandable buttocks mesh or other thin, expandable material areas 22*a* and 22*b* between the intergluteal cleft crack groove in the middle between the buttocks, extending out to the outer edges of the buttocks adjacent to the denser left and right flank members 20*a* and 20*b*.

The welts 16, 34*a* and 34*b* provide a snug fit on the user's upper waist and on the foot just before the toes begin without overly constricting these areas. Preferably, a single rubber yarn is knitted into the knitted-in welt 16, 34*a* and 34*b* to ensure that the waistband and foot bands are secured about the waist and feet of the user. However, the rubber yarn is optional because the denier used in this region is believed to be sufficient to provide the needed support. Silicone can also be used on the inseam of the welt to prevent garment from sliding. This is also optional.

The control top portion 13, including a full upper portion covering the torso of the wearer from an upper area having a circumferential welt top edge 16 located just below the breasts of the wearer down to upper thigh band regions 13*a*, 13*b*, and also including a g string region 13*g* in the middle lumbar back area between the top of the buttocks, are each thicker than the leg portions 30*a* and 30*b* to provide additional support for the buttocks and upper thigh regions.

The control top portion 13, extending from circumferential top welt edge 16 down to upper thigh band areas 13*a* and 13*b* and *g* string region 13*g* extends down to the leg portions 26*a* and 26*b*. The buttocks mesh or other thin, expandable material areas 22*a* and 22*b* provide an opening at the central top joint of buttocks mesh or other thin, expandable material areas 22*a* and 22*b* which creates the aforementioned middle lumbar back g-string region 13*g*. The opening for the wearer's hips, located below the torso portion of the control top 13 with the centrally located lumbar back g string region

13*g* is then knitted with a respective thinner garment buttocks or other thin, expandable material mesh portions 22*a* and 22*b*, preferably micro fiber, to allow the buttocks to be pushed outward without compression. A thicker denier is used to reinforce and add extra support, lift and compression to the area just below the buttocks at the bottom of flank portions 20*a* and 20*b* which extends from the bottom edge of the buttocks mesh or other thin, expandable material portions 22*a* and 22*b*, thence up the side of the garment through the upper torso portion 13, to the top of the control top welt 16. This thicker fabric of flank portions 20*a* and 20*b*, as well as of the circumferential upper thigh band areas 13*a*, 13*b*, provides a compression of the hosiery undergarment just below the buttocks, creating more bulge on the less compressive mesh or other thin, expandable material buttocks areas 22*a*, 22*b*, making the buttocks of the wearer look bigger, while lifting the buttocks of the wearer at the same time, preferably having a denier of about 150, but thickness may optionally range from approximately 60 to approximately 200 in denier. The differences in thickness between the upper waist band welt 16, leg bands 13*a*, 13*b*, and side flank regions 20*a*, 20*b* of control top 13 are indicated by the shaded areas, i.e. shading, and the shaded areas indicate thicker or thinner fabric from the control top. The control top portion 13, and including side flank regions 13*a*, 13*b*, also preferably extends upwards to just under the breast area 16 and down the leg portions 30*a* and 30*b*. The lines 26*a* and 26*b* indicate the locations where the control top portion 13, 13*a* and 13*b* ends and the leg portions 30*a* and 30*b* begin. Preferably, the control top portion 13, 13*a* and 13*b* is manufactured using a plane-knit process. In accordance with one embodiment, each of the feeds contains a single yarn, preferably, LYCRA® yarn, which is a product of E. I. Du Pont® de Nemours and Company®, or SPANDEX® yarn, which is a more generic term for the same or substantially similar material manufactured by many different manufacturers. Preferably, the SPANDEX® or LYCRA® has a denier of about 120, but may optionally range from approximately 60 to approximately 200 in denier. The control top has a thicker fabric on the waist enhancing side areas 18*a* and 18*b* which supports the sides of the waist, preferably the SPANDEX® or LYCRA® has a denier of 160, but may range from approximately 60 to approximately 200 in denier. A thicker fabric may be used on side flank portions 20*a* and 20*b* which controls side bulge and support and lift the buttocks, preferably, the SPANDEX® or LYCRA® has a denier of 150, but may range from approximately 60 to approximately 200 in denier. Waist enhancing side areas 18*a* and 18*b* are located in the left and right waist portions of the side flank portions 20*a* and 20*b*. In a preferred option, waist enhancing side areas 18*a* and 18*b* are the thickest of the materials in the butt enhancing undergarment.

The optional control top has a thicker fabric on the front stomach wall portion 28, to compress the stomach area, preferably the SPANDEX® or LYCRA® has a denier of 150, but may range from approximately 60 to approximately 200 in denier. The leg portions 30*a* and 30*b* of the hosiery undergarment have a denier ranging from approximately 5 to approximately 100 deniers.

Alternatively, the plane-knit process used for the control top could utilize a 120-denier SPANDEX® or LYCRA® yarn. The knitted-in welts 16 comprise the thickest area of the garment. The control top portion 13, 13*a*, 13*b* and 13*g* is thicker than the leg portions 20*a*, and 20*b* which provide side and buttocks support and lift is thicker than the control top base 13, which includes upper thigh portions 13*a*, 13*b* and g string portion 13*g*. The thickest part of the control top base is included at welt 16, abdominal wall portion 28, flank portions 20*a*, 20*b* and mid flank waist portions 18*a*, and 18*b* which provide stomach compression and side waist shaping compression, with mid flank waist portions 18*a* and 18*b* being thicker than abdominal wall portion 28 and flank portions 20*a* and 20*b*.

Figure 5:
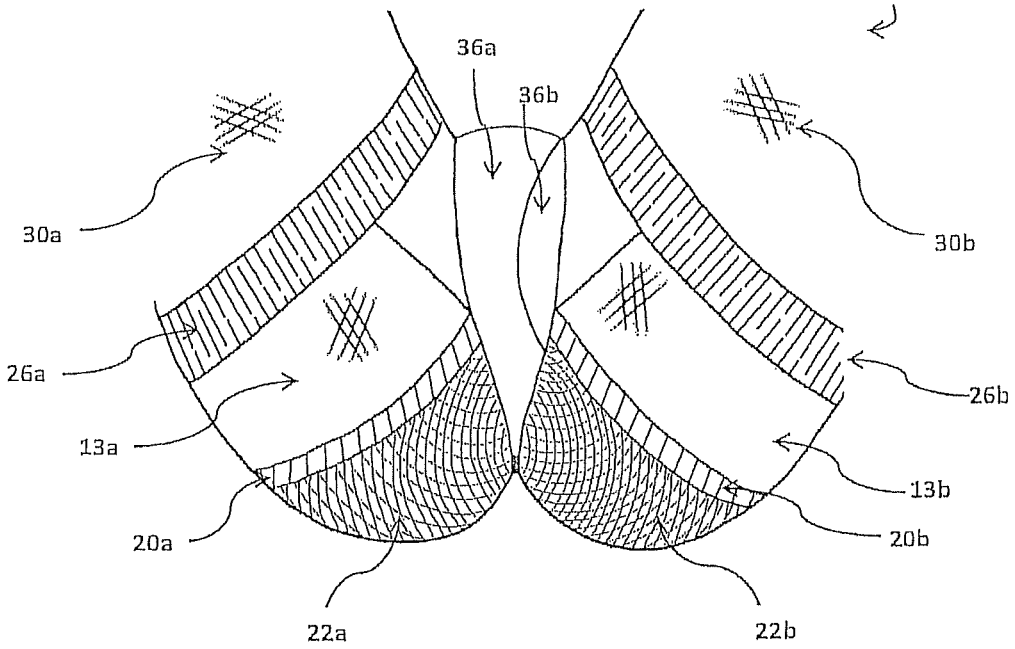
FIG. 5 illustrates a bottom perspective view of the open crotch double gusset of the hosiery undergarment of the present invention.

FIG. 5 shows an enlarged view of the crotch open double gusset 36 (as shown in FIG. 1), with flaps 36*a* and 36*b*, which is made of cotton with two overlaying pieces of cotton fabric. The crotch open double gusset region 36, 36*a* and 36*b* open wide enough for convenience when wearer needs to use the restroom. The crotch double gusset region 36, 36*a*, 36*b*, preferably is sewn onto the garment after the knitting process has been performed.

Figure 6:
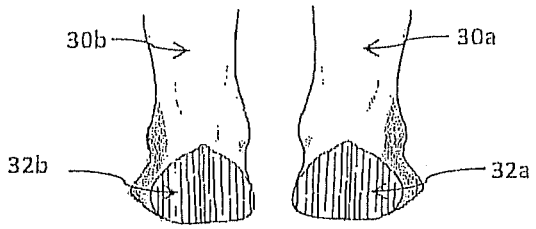
FIG. 6 illustrates a rear detail perspective view of the reinforced heel of the hosiery undergarment of the present invention.

Referring to FIG. 6 the heel portion of the hosiery undergarment 32*b* and 32*a* shows a reinforced heel with a thicker fabric than the leg portion of the hosiery garment 30*a* and 30*b*. This prevents it from running or tearing at the heel from usage.

Figure 7:
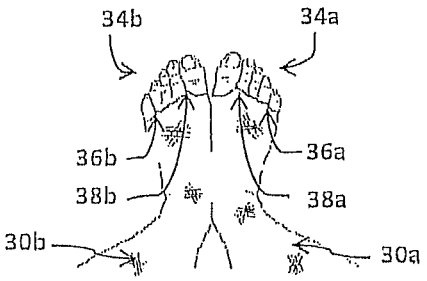
FIG. 7 illustrates a top plan detail perspective view of the open toe of the hosiery undergarment of the present invention.

FIG. 7 is an enlarged view of the of the open toe foot portion of the hosiery garment with knitted welts 34*a* and 34*b*. Two straps on each foot can be seen at 38*a*, 38*b* which is received between the first and second toes of the wearer in a thong-type arrangement. A strap is also goes between the fourth and fifth toe at 36*a* and 36*b* also in a thong type arrangement. This secures the hosiery garment from rolling up the foot. The open toe portion also extends the life of the hosiery garment due to the fact that the toe portions are the first to tear and become worn.

Figure 8:
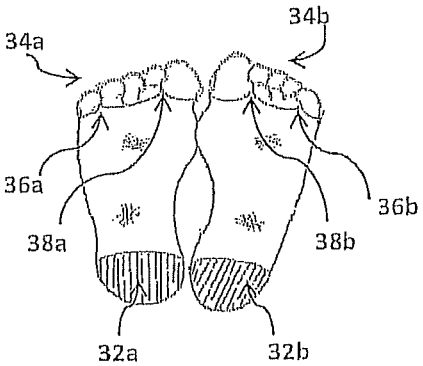
FIG. 8 illustrates a bottom detail perspective view of the foot sole reinforced heel and the open toe of the Hosiery undergarment of the present invention.

FIG. 8 is an enlarged view of the foot sole portion of the hosiery undergarment. It details the straps as shown in FIG. 7, as well as the reinforced heel as shown in FIG. 6.

The optional leg portions 30*a* and 30*b* preferably are terminated with knitted-in welts 34*a* and 34*b* just before the toes, however in alternate embodiments in FIGS. 9-13, the leg portions may terminate at upper thigh ring portions 26*a* and 26*b*, or at 28*a* and 28*b*, at 42*a* and 42*b*. In all new embodiments there would be a triangle in the inner leg portions in a lesser denier to release pressure and reduce leg bulge where the garment ends. For example in FIG. 9, the garment's bottom ends at upper thigh ring portions 26*a*, 26*b*, having respective triangular release areas 27*a* and 27*b*.

Additionally, in the embodiment shown in FIG. 10 where the hosiery/shaper garment ends with above the knee ring portions 28*a* and 28*b*, there are provided triangular release areas 29*a* and 29*b*.

Similarly, where the hosiery/shaper garment ends just above the ankles as in FIG. 11, the ankle ring portions 42*a* and 42*b* have respective triangular release areas 43*a* and 43*b*.

Also in other embodiments there may be provided a long sleeve version or a short sleeve version, with long sleeve arm portions 50*a* and 50*b*, or short sleeve arm portions (not shown) extending outward from an optional closed back of control top portion 13.

In an alternate embodiment FIG. 13 there is provided an open back region provided in control top portion 13, between right and left connecting appendages 62*a* and 62*b*, between the uppermost edge of control top portion 13 and the lower distal portions of shoulder straps 64*a* and 64*b*. Optionally a removable band or strap with hooks 60*a* and 60*b*, preferably made with elastic material or a clear silicone strap, is sewn to respective appendages 62*a* and 62*b*, and extends across the open lower back portion above the top edge of control top portion 13. The removable band or strap with hooks 60*a* and 60*b*, when utilized, accentuates the waist of the wearer, for a tighter slimmer look from the front.

This embodiment can also end at a lower waist region in other embodiments. Straps 64*a* and 64*b*, which provide an over the shoulder strap support, help keep the hosiery/shaper garment from falling down, and are preferably made with plastic or silicone removable straps, but may also be made with elastic bands.

Figure 14:
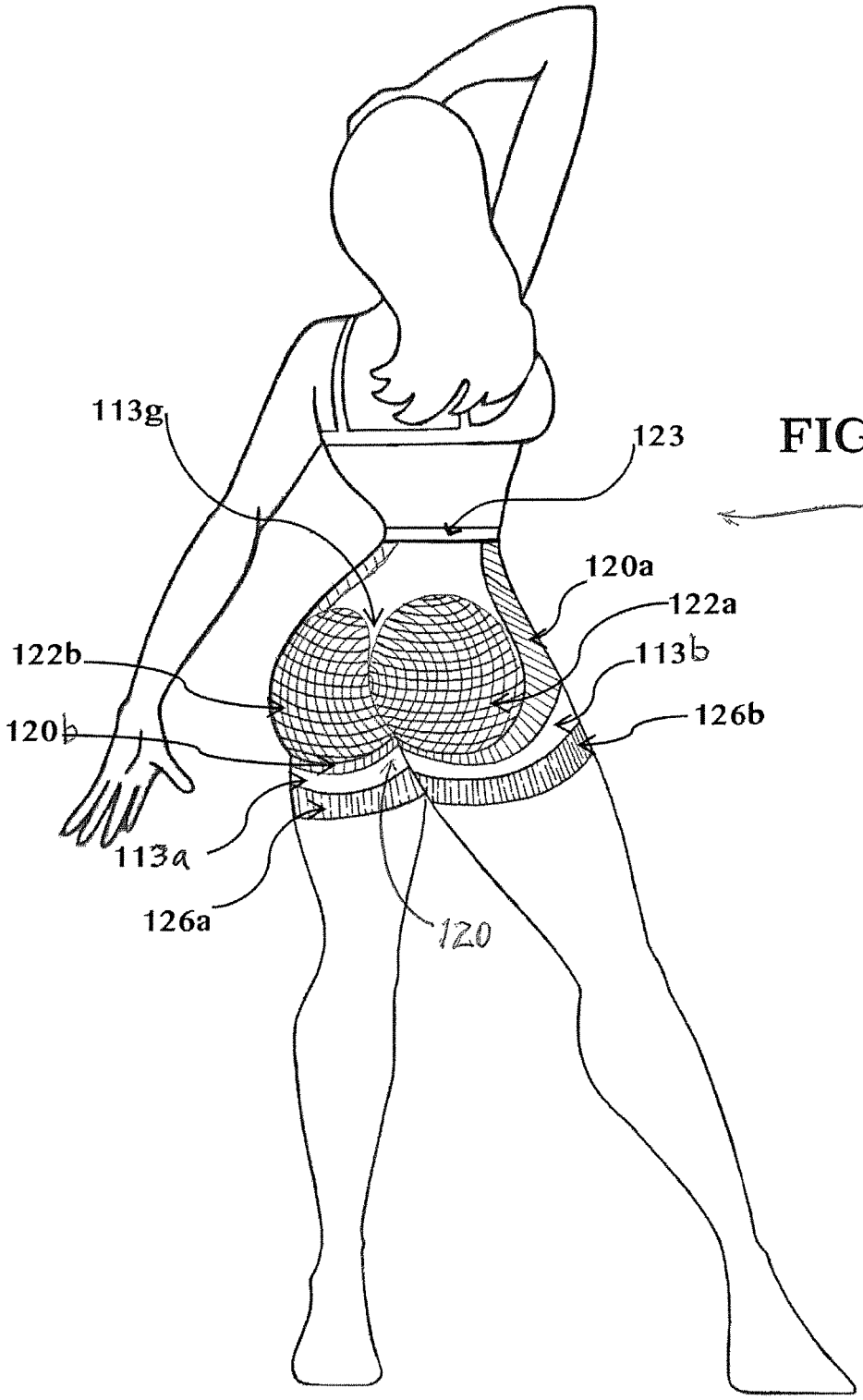
FIG. 14 illustrates a rear perspective view of the undergarment of the present invention in a panty shorts version, with an upper elastic waistband and two lower leg accommodating rings below the lower crotch area.

It is also noted in the alternate embodiment of FIG. 14 that the undergarment can be limited to a "panty" area from an elastic waist band down to the crotch area with two leg holes. It can be limited to the mesh or other thin, expandable material buttocks area, and the adjacent supporting flank and crotch areas. However, it can also have an optional upper abdominal area. In this embodiment the undergarment is only the mesh buttocks area and the minimal portions of thicker material to make the buttocks extend outward.

For example, in the panty shorts embodiment of FIG. 14, the butt enhancing undergarment 101 may include:

a) a snug fitting continuous top waist band 123 adapted to fit about the waist and below the breast and upper abdominal area of the wearer of the undergarment and a lower crotch covering portion 120 having a pair of open leg holes 113*a*, 113*b* for insertion of the wearer's legs therein;

b) the undergarment 101 extending down from the snug fitting continuous top waist band 123 of the undergarment 101 to at least the lower crotch covering portion 120 having the open leg accommodating rings 126*a*, 126*b;* c) respective flank supporting portions 120*a*, 120*b* provided adjacent to respective buttocks mesh or other thin, expandable material areas of the undergarment 101;

d) the flank support portions 120*a*, 120*b* being made with a thicker denier than the buttocks mesh or other thin, expandable material regions 122*a*, 122*b* to reinforce and add extra support, lift and compression thereof;

e) the respective flank supporting portions 120*a*, 120*b* extending along outer peripheral edges of the respective buttocks mesh or other thin, expandable material regions 122*a*, 122*b* and thence extending continuously under respective bottom peripheral edges of the respective buttocks mesh or other thin, expandable material regions, the flank supports 120*a*, 120*b* pulling the buttocks mesh or other thin, expandable material regions 122*a*, 122*b* from the respective left and right outer peripheral edges thereof and simultaneously having a lower crotch support area 120 supporting the respective bottom peripheral edges of the respective buttocks mesh or other thin, expandable material regions 122*a*, 122*b* from below, whereby the buttocks mesh or other thin, expandable material regions 122*a*, 122*b* are further pushed outward without compression;

f) the buttocks mesh or other thin, expandable material regions 122*a*, 122*b* being made from a garment material thinner and less compressive than the garment material making up a remainder thicker flank areas 120*a*, 120*b*, waistband 123 and lower crotch area 120 of the undergarment, thereby allowing the buttocks to be pushed outward without compression;

g) the thinner and less compressive buttocks mesh or other thin, expandable material regions 122*a*, 122*b* covering the buttocks of the wearer, the buttocks mesh or other thin, expandable material regions 122*a*, 122*b* separated from each other only by a separation 113*g* in the intergluteal cleft crack groove that runs below the sacrum of the spine between the buttocks to the perineum area of the crotch between the buttocks regions, in the area extending below the sacrum to the perineum area of the crotch between the legs;

h) the thinner and less compressive buttocks mesh or other thin, expandable material regions 122*a*, 122*b* also separated from the thicker waistband 123, lower crotch support area 120 and the respective denser left and right flank support portions 120*a*, 120*b* by a corresponding minimal seamless separations between respective outer left and right circumferential arc portions of the rear thinner and less compressive buttocks mesh or other thin, expandable material regions 122*a*, 122*b;* i) open leg-accommodating thigh ring cuffs 126*a*, 126, located at the bottom of panty shorts garment 101, and optionally connected by annular cuff connectors 113*a*, 113*b* to the bottom buttocks supporting portions of thicker flank supporting portions 120*a*, 120*b* in the lower crotch support area 120 of garment 101; where optionally thigh ring cuffs 126*a*, 126*b* can be directly connected to the bottom buttocks supporting portions of the thicker lank supporting portions 120*a*, 120*b* in lower crotch support area 120;

j) thereby the thinner and less compressive buttocks mesh or other thin, expandable material regions 122*a*, 122*b* capturing all of each of the buttocks of the wearer in the thin left and right expandable buttocks mesh or other thin, expandable material areas 122*a*, 122*b*.

This butt enhancing undergarment 101 of FIG. 14 may also have the flank supporting portions 120*a*, 120*b* optionally extending up sides of the undergarment above the waist band in the ribs and mid abdominal area of the wearer, to an upper waist welt below the breasts of the wearer, similar to flank supporting areas 20*a*, 20*b* of FIGS. 2-4 and 10-13. Optionally, panty shorts garment 101 can have full or partial arm sleeves 50*a*, 50*b* of FIG. 12.

In all of the above embodiments of FIGS. 1-14, the undergarment may also have discrete, opaque, thin buttocks enclosing areas 22*a*, 22*b* shown in FIGS. 1-13 or areas 122*a*, 122*b* of the panty shorts version shown in FIG. 14. In those versions with thin opaque, non-mesh material will not be a "see through" mesh or netting, but will be opaque, and therefore provide the ability for the undergarments to also function as outer garments.

In the foregoing description, certain terms and visual depictions are used to illustrate the preferred embodiment. However, no unnecessary limitations are to be construed by the terms used or illustrations depicted, beyond what is shown in the prior art, since the terms and illustrations are exemplary only, and are not meant to limit the scope of the present invention.

It is further known that other modifications may be made to the present invention, without departing the scope of the invention, as noted in the appended Claims.

We claim:

1. A butt enhancing hosiery/shaper undergarment comprising:

said undergarment extending from an upper waist area to a leg accommodating ring of a wearer manufactured in one, continuous knitting process without any seams or elastic bands; a snug fitting upper waist knitted-in welt adapted to fit about the waist and below the breast area of the wearer of said undergarment;

said undergarment extending down from said upper waist welt forming a control top portion of said undergarment;

an area directly below respective buttocks mesh areas of said hosiery/shaper undergarment extending up sides of said undergarment to said upper waist welt comprising a pair of flank supports extending and tapering down from said upper waist welt along respective left and right outer peripheral edges of said respective buttocks mesh regions and thence extending continuously under respective bottom peripheral edges of said respective buttocks mesh regions, said flank supports pulling said buttocks mesh regions from said respective left and right outer peripheral edges thereof and simultaneously supporting said respective bottom peripheral edges of said respective buttocks mesh regions from below, whereby said buttocks mesh regions are further pushed outward without compression;

said control top portion having regions corresponding to the buttocks of said wearer;

said buttocks mesh regions being fully covered by garment material thinner and less compressive than said garment material making up a remainder of said control top portion allowing said buttocks to be pushed outward without compression;

said thinner and less compressive buttocks mesh regions covering all of the buttocks of the wearer, said buttocks mesh regions separated from each other only by, and directly contacting, a minimal seamless narrow g-string region separation in the intergluteal cleft crack groove that runs below the sacrum of the spine between the buttocks to the perineum area of the crotch between said buttocks regions, in the area extending below the sacrum to the perineum area of the crotch between the legs, said thinner and less compressive buttocks mesh regions also separated from said respective denser left and right flank members by a corresponding minimal seamless separations between respective outer left and right circumferential arc portions of the rear thinner and less compressive buttocks mesh regions, thereby said thinner and less compressive buttocks mesh regions capturing all of each of the buttocks of the wearer in said thin left and right expandable buttocks mesh areas, and open leg-accommodating portions extending down at least a portion of respective legs of the wearer from said control top portion.

2. The butt enhancing hosiery/shaper undergarment as in claim 1 wherein said minimal seamless separation in the intergluteal cleft crack groove between the left and right buttocks mesh regions is about one quarter (¼) inch in width.

3. The butt enhancing hosiery/shaper undergarment as in claim 1 wherein said minimal seamless separations separating said rear buttocks mesh regions from respective left and right flank members are about one quarter (¼) inch in width.

4. The butt enhancing hosiery/shaper undergarment of claim 1 in which an area directly below said buttocks in said control top portion is knitted with a thicker denier than said buttocks regions to reinforce and add extra support, lift and compression, said area extending up sides of said undergarment to said upper waist welt.

5. The butt enhancing hosiery/shaper undergarment of claim 4 in which an area corresponding to the side waist area of a user is the thickest part of said upper control top to provide stomach and side waist compression.

6. The butt enhancing hosiery/shaper undergarment of claim 5 in which each said open leg-accommodating portion has an upper thigh ring cuff, adapted to terminate above the knees of the wearer.

7. The butt enhancing hosiery/shaper undergarment of claim 5 in which a crotch portion thereof includes overlaying pieces of cotton fabric.

8. The butt enhancing hosiery/shaper undergarment of claim 5 in which said open leg-accommodating portions each have a reinforced heel to prevent tearing during use.

9. The butt enhancing hosiery/shaper undergarment of claim 5 in which said open leg-accommodating portions extend down from said top portion are adapted to terminate just before the toes of the wearer forming an open toe portion, thereby leaving said toes uncovered.

10. The butt enhancing hosiery/shaper undergarment of claim 5 in which said open leg-accommodating portions having triangular portions of lesser denier on an inside thigh region to release pressure and reduce leg bulge.

11. The butt enhancing hosiery/shaper undergarment of claim 5 in which said open leg-accommodating portions extend down from said top portion are adapted to terminate below the knees of the wearer.

12. The butt enhancing hosiery/shaper undergarment of claim 5 in which said open leg-accommodating portions extend down from said top portion are adapted to terminate above the ankles of the wearer.

13. The butt enhancing hosiery/shaper undergarment of claim 9 in which said open toe portion terminates in knitted welts, with one or more straps on each said open leg-accommodating portion extend between adjacent toes to prevent roll up of said undergarment on a foot of said wearer.

14. The butt enhancing hosiery/shaper undergarment of claim 4 in which said upper welt is knitted material and lined on an underside with a lining to prevent said upper welt from sliding down.

15. The butt enhancing hosiery/shaper undergarment of claim 4 in which said upper welt has one or more detachable and adjustable straps for hooking into a bra of said wearer to prevent said upper welt from sliding down.

16. The butt enhancing hosiery/shaper undergarment of claim 1 further comprising a region covering an upper back and chest of the wearer, further comprising a pair of at least partial length arm sleeves extending therefrom.

17. A method of enhancing the butt of a wearer of an undergarment comprising the steps of:

extending said undergarment from an upper waist area to a leg accommodating ring of a wearer manufactured in one, continuous knitting process without any seams or elastic bands;

providing a hosiery/shaper undergarment, fitting a snug fitting upper waist welt about the waist and below the breast area of the wearer of said undergarment;

providing a control top portion of said undergarment in an area extending down from said upper waist welt of said undergarment;

providing an area directly below respective buttocks mesh areas of said hosiery/shaper undergarment extending up sides of said undergarment to said upper waist welt comprising a pair of flank supports extending and tapering down from said upper waist welt along respective left and right outer peripheral edges of said respective buttocks mesh regions and thence extending continuously under respective bottom peripheral edges of said respective buttocks mesh regions, said flank supports pulling said buttocks mesh regions from said respective left and right outer peripheral edges thereof and simultaneously supporting said respective bottom peripheral edges of said respective buttocks regions from below, whereby said buttocks regions are further pushed outward without compression;

covering the wearer's buttocks with mesh regions corresponding to the buttocks of said wearer;

making said buttocks mesh regions from garment material thinner and less compressive than garment material making up a remainder of said control top portion allowing said buttocks to be pushed outward without compression;

covering, all of the buttocks of the wearer with said thinner and less compressive buttocks mesh regions, said thinner and less compressive buttocks mesh regions separated from each other only by, and directly contacting, a minimal seamless narrow g-string region separation in the intergluteal cleft crack groove that runs below the sacrum of the spine between the buttocks to the perineum area of the crotch between said buttocks regions, in the area extending below the sacrum to the perineum area of the crotch between the legs, said thinner and less compressive buttocks mesh regions also separated from said respective denser left and right flank members by a corresponding minimal seamless separations between respective outer left and right circumferential arc portions of said thinner and less compressive rear buttocks regions, thereby said thinner and less compressive buttocks mesh regions capturing all of each of the buttocks of the wearer in said thin, less compressive left and right expandable buttocks areas, and respective open leg-accommodating portions extending down at least a portion of respective legs of the wearer from said control top portion;

providing said undergarment with an area directly below said buttocks in said control, top portion and knitting said area below said buttocks with a thicker denier than said buttocks mesh regions to reinforce and add extra support, lift and compression, said thicker denier area extending up sides of said undergarment to said upper waist welt;

providing an area corresponding to the side waist area of a user being the thickest part of said upper control top to provide stomach and side waist compression.

18. A butt enhancing garment comprising: an undergarment extending from an upper waist area to a leg accommodating ring of a wearer manufactured in one, continuous knitting process without any seams or elastic bands; a snug fitting continuous top waist knitted in band adapted to fit about the waist and below the breast area of the wearer of said undergarment and a lower crotch covering portion having a pair of open leg accommodating ring cuffs for insertion of the wearer's legs therein;

said garment extending down from said snug fitting continuous top waist band to at least said lower crotch covering portion having said open leg accommodating ring cuffs, respective flank supporting portions provided adjacent to respective buttocks areas of said garment, said flank support portions being made with a thicker denier than said buttocks regions to reinforce and add extra support, lift and compression thereof, said respective flank supporting portions extending along outer peripheral edges of said respective buttocks regions and thence extending continuously and tapering under respective bottom peripheral edges of said respective buttocks regions, said flank supports pulling said buttocks regions from said respective left and right outer peripheral edges thereof and simultaneously supporting said respective bottom peripheral edges of said respective buttocks regions from below, whereby said buttocks regions are further pushed outward without compression;

said buttocks regions being made from garment material thinner and less compressive than said garment material making up a remainder of said garment, thereby allowing said buttocks to be pushed outward without compression;

said thinner and less compressive buttocks regions covering the buttocks of the wearer, said buttocks regions separated from each other only by a minimal seamless narrow g-string region separation in the intergluteal cleft crack groove that runs below the sacrum of the spine between the buttocks to the perineum area of the crotch between said buttocks regions, in the area extending below the sacrum to the perineum area of the crotch between the legs, said thinner and less compressive buttocks regions also separated from said respective denser left and right flank support portions by a corresponding minimal seamless separations between respective outer left and right circumferential are portions of the rear thinner and less compressive buttocks regions, and thereby said thinner and less compressive buttocks regions capturing all of each of the buttocks of the wearer in said thin left and right expandable buttocks areas.

19. The butt enhancing garment of claim 18 further comprising said flank supporting portions optionally extending up sides of said garment above said waist band in the ribs and mid abdominal area of the wearer, to an upper waist welt below the breasts of the wearer.

20. The butt enhancing garment of claim 18 further comprising a pair of leg portions extending at least partially below said pair of leg accommodating ring cuffs.

21. The butt enhancing garment of claim 18 wherein said buttocks regions are made of at least one mesh material for wearing as an undergarment.

22. The butt enhancing garment of claim 18 wherein said buttocks regions are discretely opaque for wearing as an outer garment.

23. The butt enhancing garment of claim 18 wherein said leg portions terminate in release areas on opposite sides of said leg accommodating ring portion.

24. The butt enhancing garment of claim 1 wherein said leg portions extend down from said top portion and are adapted to terminate above the knees of the wearer.

25. The butt enhancing garment of claim 18 wherein said leg portions extend down from said top portion and are adapted to terminate above the knees of the wearer.

* * * * *